US011477551B2

(12) United States Patent
Kumar

(10) Patent No.: US 11,477,551 B2
(45) Date of Patent: Oct. 18, 2022

(54) VOICE-ENABLED DEVICE RECESSED INSTALLATION

(71) Applicant: SIGNIFY HOLDING B.V., Eindhoven (NL)

(72) Inventor: Jyoti Kumar, Tyrone, GA (US)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/110,816

(22) Filed: Dec. 3, 2020

(65) Prior Publication Data

US 2021/0176546 A1 Jun. 10, 2021

Related U.S. Application Data

(60) Provisional application No. 62/944,778, filed on Dec. 6, 2019.

(51) Int. Cl.
*H04R 1/02* (2006.01)
*F21V 33/00* (2006.01)

(52) U.S. Cl.
CPC ..... *H04R 1/025* (2013.01); *H04R 1/028* (2013.01); *F21V 33/0056* (2013.01)

(58) Field of Classification Search
CPC ..... H04R 1/025; H04R 1/028; F21V 33/0056
USPC ..... 381/97
See application file for complete search history.

(56) References Cited

U.S. PATENT DOCUMENTS

| | | | | |
|---|---|---|---|---|
| 6,578,808 | B1 * | 6/2003 | Bertagni | H04R 1/025 248/343 |
| 2016/0261824 | A1 * | 9/2016 | Scalisi | H04N 5/2256 |
| 2018/0350363 | A1 * | 12/2018 | Cook | G06F 3/165 |
| 2020/0037419 | A1 * | 1/2020 | Scott | H05B 45/60 |
| 2020/0124272 | A1 * | 4/2020 | Spencer | G02B 6/0018 |

* cited by examiner

*Primary Examiner* — Sean H Nguyen

(57) ABSTRACT

The disclosure is directed to a mounting assembly for the recessed installation of a voice-enabled device. The mounting assembly comprises a trim comprising an outer flange, an inner flange, and a wall section. At least a portion of the outer flange of the trim is designed to be positioned below a ceiling, and the inner flange is designed for positioning the voice-enabled device thereon. The mounting assembly also comprises retaining structures that are attached to the wall section. The retaining structures are designed to hold the voice-enabled device on the inner flange.

11 Claims, 14 Drawing Sheets

VOICE-ENABLED DEVICE RECESSED INSTALLATION

TECHNICAL FIELD

The present disclosure relates generally to voice-enabled devices, and more particularly to installations of voice-enabled devices.

BACKGROUND

The use of voice-enabled devices, such as smart speakers, voice assistant devices, and other devices that may include a microphone and a speaker and respond to voice commands, has become widespread. For example, Amazon's ECHO and Google's HOME widely used. In some cases, placing a voice-enabled device at a desired location may be challenging. For example, the voice-enabled device may add to the clutter of a space. However, placing a voice-enabled device at a location that minimizes its aesthetic impact may interfere with the effective use of the voice-enabled device. Further, an electrical cable that is used to power or charge a voice-enabled device can add to the clutter. Thus, a solution that enables convenient placement of voice-enabled devices is desirable.

BRIEF DESCRIPTION OF THE FIGURES

Reference will now be made to the accompanying drawings, which are not necessarily drawn to scale, and wherein.

Figure 1:
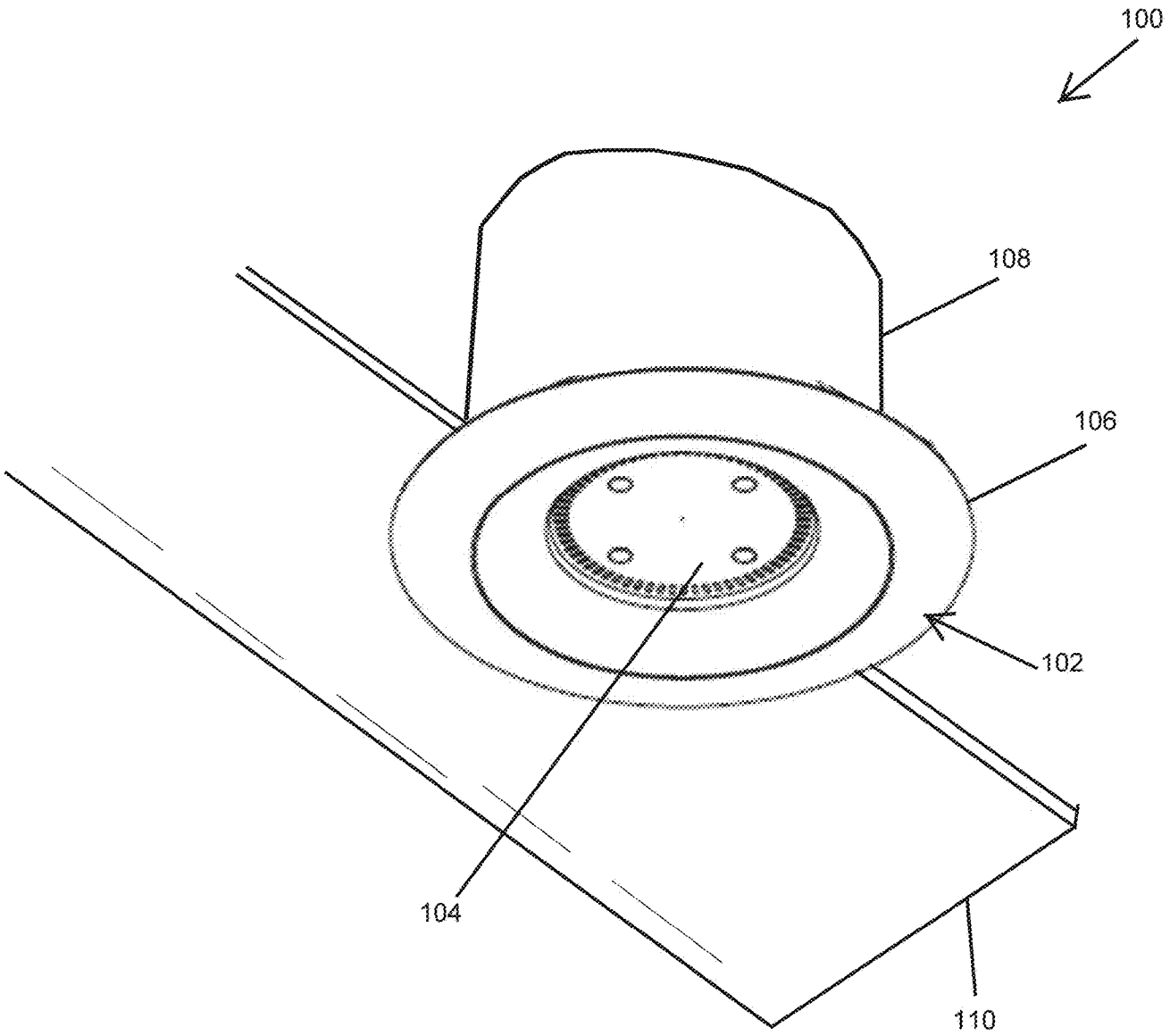
FIG. 1 illustrates a voice-enabled device fixture according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, the same reference numerals used in multiple drawings may designate like or corresponding but not necessarily identical elements.

DETAILED DESCRIPTION OF EXAMPLE EMBODIMENTS

In the following paragraphs, particular embodiments will be described in further detail by way of example with reference to the figures. In the description, well known components, methods, and/or processing techniques are omitted or briefly described. Furthermore, reference to various feature(s) of the embodiments is not to suggest that all embodiments must include the referenced feature(s).

Turning now to the drawings, FIG. 1 illustrates a voice-enabled device fixture 100 according to an example embodiment. In some example embodiments, the voice-enabled device fixture 100 includes a voice-enabled device assembly 102 and a housing 108. For example, the housing 108 may be a recessed can that is typically used with recessed lighting fixtures. The voice-enabled device assembly 102 may include a voice-enabled device 104 and a trim 106. For example, the voice-enabled device 104 may be Amazon's ECHO, Google's HOME, or another voice-enabled device.

In some example embodiments, the voice-enabled device assembly 102 may be recessed behind a ceiling 110. For example, at least a portion of the voice-enabled device 104 may be in a cavity of the housing 102 that is behind the ceiling 110. A section of the trim 106 may be positioned below the ceiling 110, and another section of the trim 106 may extend through an opening in the ceiling 110 into the housing 108.

In some alternative embodiments, the voice-enabled device 104, the trim 106, and the housing 108 may each have a different shape than shown. For example, the outer perimeter of the trim 102 may have a rectangular shape or another shape. In some example embodiments, the housing 108 may have one or more openings for routing one or more electrical wires to the voice-enabled device 104, for air flow, etc.

Figure 2:
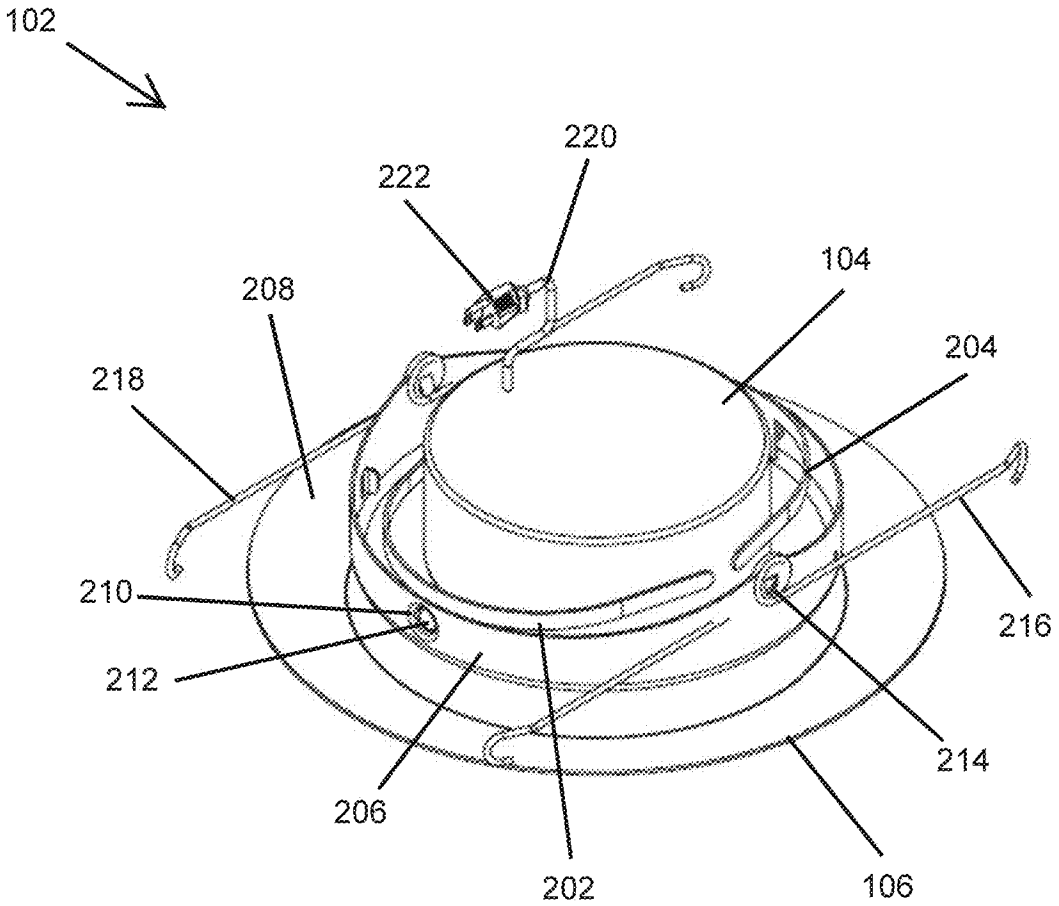
FIG. 2 illustrates a voice-enabled device assembly of the voice-enabled device fixture of FIG. 1 according to an example embodiment.
Figure 3:
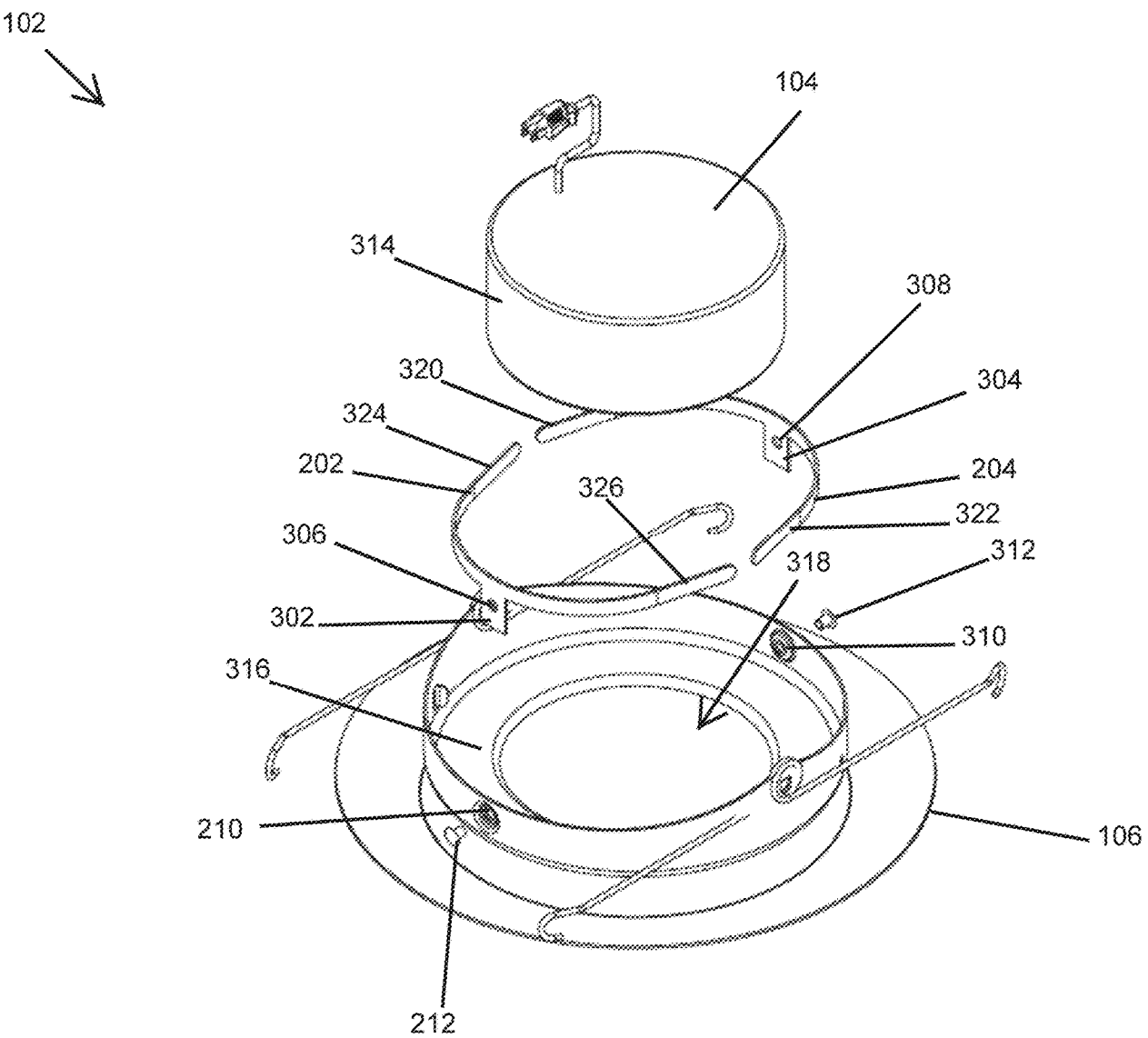
FIG. 3 illustrates an exploded view of the voice-enabled device assembly of FIG. 2 according to an example embodiment.

FIG. 2 illustrates the voice-enabled device assembly 102 of the voice-enabled device fixture 100 of FIG. 1 according to an example embodiment, and FIG. 3 illustrates an exploded view of the voice-enabled device assembly 102 shown in FIG. 2 according to an example embodiment. Referring to FIGS. 1-3, in some example embodiments, the voice-enabled device assembly 102 may include the voice-enabled device 104, the trim 106, and retaining spring brackets 202, 204 that are retaining structures that hold the voice-enabled device 104 in place attached to the trim 102.

In some example embodiments, the trim 106 may have a wall section 206 and an outer flange section 208. For example, the wall section 206 may extend up from the outer flange section 208. At least a portion of the flange section 208 may be below the ceiling 110 and may also be in contact with the ceiling 110. The trim 106 may include torsion spring attachment tabs, such as an attachment tab 214, for attaching torsions springs 216, 218 to the trim 106. For example, the torsions springs 216, 218 may be used to attach the voice-enabled device assembly 102 to the housing 108 as can be readily understood by those of ordinary skill in the art with the benefit of this disclosure. In some alternative embodiments, the torsions springs 216, 218 may be omitted and the voice-enabled device assembly 102 to the housing 108 or to another structure using other means without departing from the scope of this disclosure.

In some example embodiments, the retaining spring brackets 202, 204 may be attached to the trim 106. To illustrate, the retaining spring bracket 202 may include a tab 302 that includes a hole 306, and the wall section 206 of the trim 106 may include a corresponding hole 210. A fastener 212 (e.g., a screw, a rivet, etc.) may extend through the holes 210 and 306 to securely attach the bracket 202 to the trim 106. Similarly, the retaining spring bracket 204 may include a tab 304 that includes a hole 308 and the wall section 206 of the trim 106 may include a corresponding hole 310. A fastener 312 (e.g., a screw, a rivet, etc.) may extend through the holes 310 and 308 to securely attach the bracket 202 to the trim 106.

In some example embodiments, each of the retaining spring brackets 202, 204 may include arms that are pushed outwardly by the voice-enabled device 104 when the voice-enabled device 104 is positioned between the arms. The bracket 204 includes arms 320, 322 that extend around a portion of a wall 314 of the voice-enabled device 104 and hold the voice-enabled device 104 in place by pushing the voice-enabled device 104 toward each other. The bracket 202 may include arms 324, 226 that extend around another portion of the wall 314 of the voice-enabled device 104 and hold the voice-enabled device 104 in place by pushing the voice-enabled device 104 toward each other.

To illustrate, the arms of the retaining spring brackets 202, 204 may be elastic such that each arm of the respective bracket 202, 204 exerts a counteracting force when pushed or stretched outwardly, for example, by the voice-enabled device 104. For example, the retaining spring brackets 202, 204 may be made from a metal (e.g., aluminum) or another material using methods such as cutting, bending, etc. The voice-enabled device 104 may be placed between the arms of each bracket 202, 204 by pushing or pulling the arms outwardly away from each other. The retaining spring brackets 202, 204 may push the voice-enabled device 104 toward each other, thereby preventing the voice-enabled device 104 from dislodging from the brackets 202, 204. For example, the retaining spring brackets 202, 204 may be attached to the trim 106 across from each other.

In some example embodiments, the voice-enabled device 104 is positioned on an inner flange 316 of the trim 106. For example, the outer flange 208 and the inner flange 316 may be separated by the wall section 206 of the trim. When the voice-enabled device 104 is positioned on the inner flange 316, a portion of the voice-enabled device 104 is aligned with an opening 318 of the trim 106 surrounded by the inner flange 316 and may be exposed to the area below the ceiling 110. To illustrate, the opening 318 allows a person in the area below the ceiling to effectively use the voice-enabled device 104.

In some example embodiments, an electrical cable 220 may be attached to the voice-enabled device 104 to provide power to the voice-enabled device 104 from a power source (such as mains power supply, a power adapter, etc.). For example, the electrical cable 202 may be fixedly or detachably attached to the voice-enabled device 104. The electrical cable 202 may also be terminated at a connector 222, which may be a male or female connector, a standard plug, or another type of connector.

In general, a mounting assembly for the voice-enabled device 104 may include the components of the voice-enabled device assembly 102 without the voice-enabled device 104. In some example embodiments, the trim 102 may be made from a material such as plastic, metal, etc. in a similar manner as trims of recessed lighting fixtures. In some alternative embodiments, some of the components of the voice-enabled device assembly 102 may be combined into a single structure without departing from the scope of this disclosure. For example, the brackets 202, 204 may be integrated with the trim 106. In some alternative embodiments, some of the components of the voice-enabled device assembly 102 may have a different shape than shown without departing from the scope of this disclosure. For example, the arms of the brackets 202, 204 may be wider, shorter, and/or have end portions that have different shapes (e.g., bent, etc.) than shown.

Figure 4:
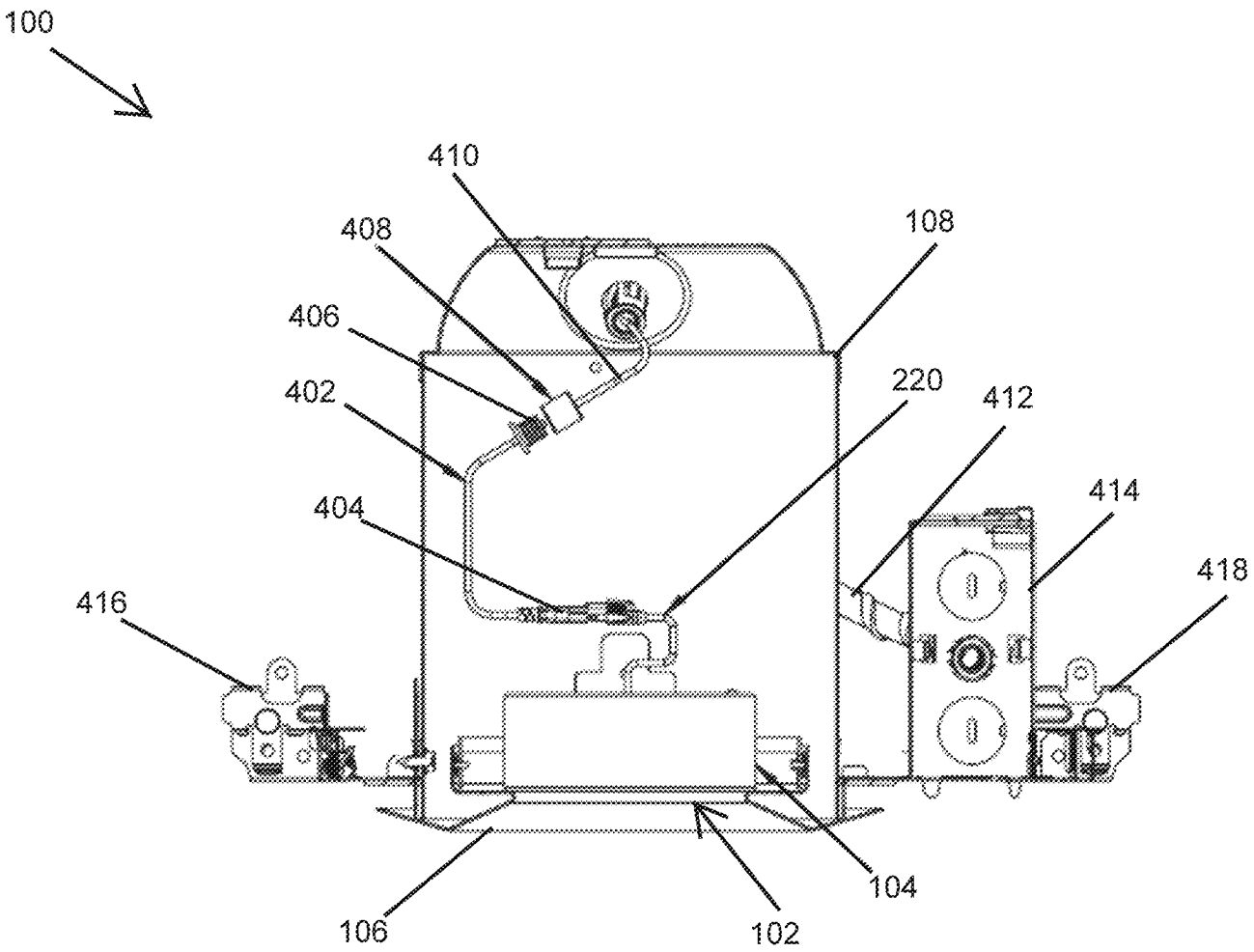
FIG. 4 illustrates a side view of the voice-enabled device fixture according to an example embodiment.

FIG. 4 illustrates a side view of the voice-enabled device fixture 100 according to an example embodiment. Referring to FIGS. 1-4, in some example embodiments, the voice-enabled device fixture 100 includes the voice-enabled device assembly 102 including the voice-enabled device 104 and the trim 106. For example, the voice-enabled device 104 may be at least partially positioned in a cavity of the housing 108.

An adapter cable 402 that is terminated by connectors 404 and 406 may be coupled to the connector 222 of the cable 220. For example, the connector 222 may be a male connector (e.g., two or three pronged), and the connector 404 of the cable 402 may be a matching female connector. The connector 406 may be an Edison plug that can be attached to an Edison socket 408. For example, the Edison socket 408 may be connected to an electrical cable 410 that is routed through a conduit arm 412 that is connected to a junction box 414.

In some example embodiments, voice-enabled device fixture 100 may be attached behind the ceiling 110 by an attachment system that includes attachment structures 416, 418 that can be attached to joists or other structures behind the ceiling 110. In some alternative embodiments, the attachment system including the attachment structures 416, 418 may be newly installed or existing structures. In some example embodiments, the Edison socket 408 may be an existing socket that may have been previously used to provide power to a light source of a lighting fixture. The housing 108 may also be an existing housing. Alternatively, the Edison socket 408 and the housing 108 as well as some of the other structures be newly installed. In some example embodiments, the housing 108 may include multiple holes, for example, to allow air flow into and out of the housing 108.

Figure 5:
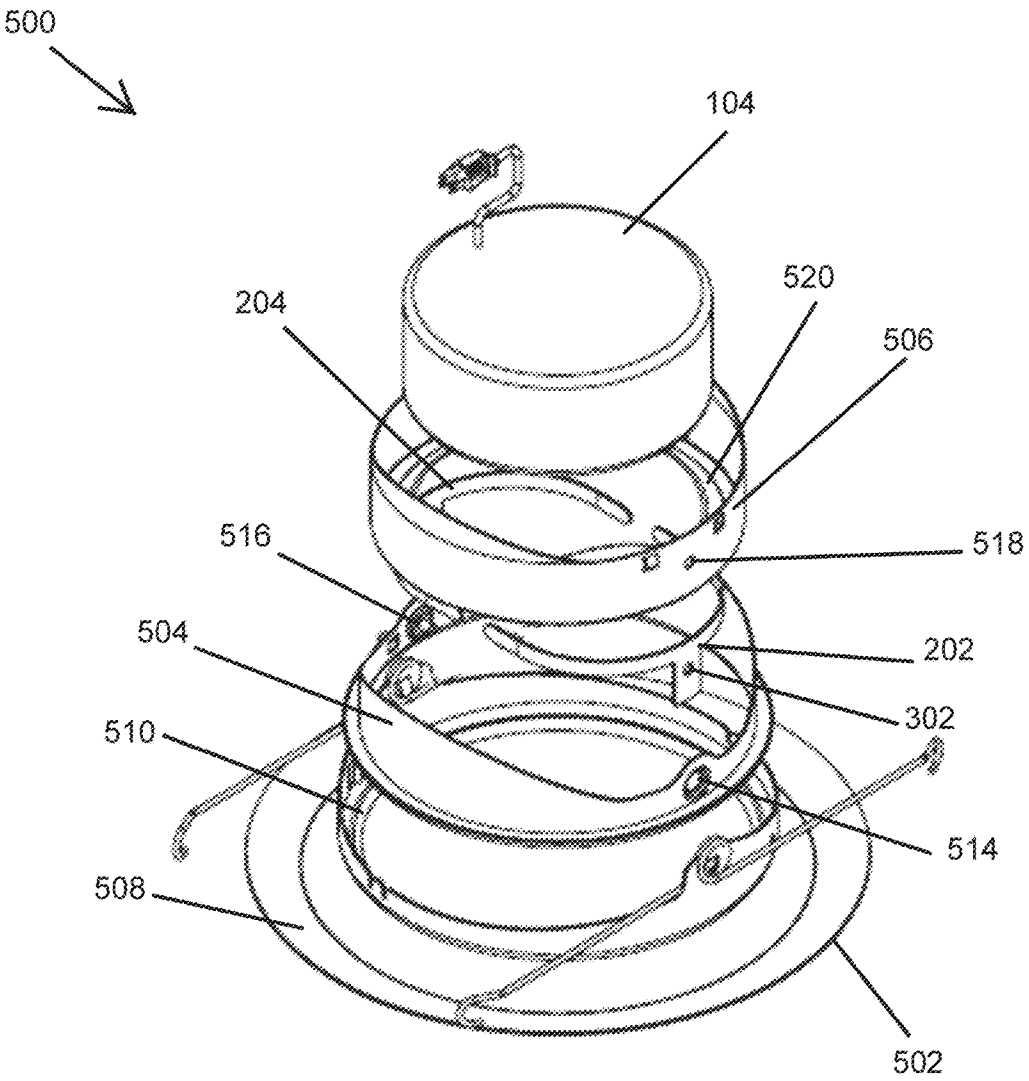
FIG. 5 illustrates an exploded view of a voice-enabled device assembly according to another example embodiment.
Figure 6:
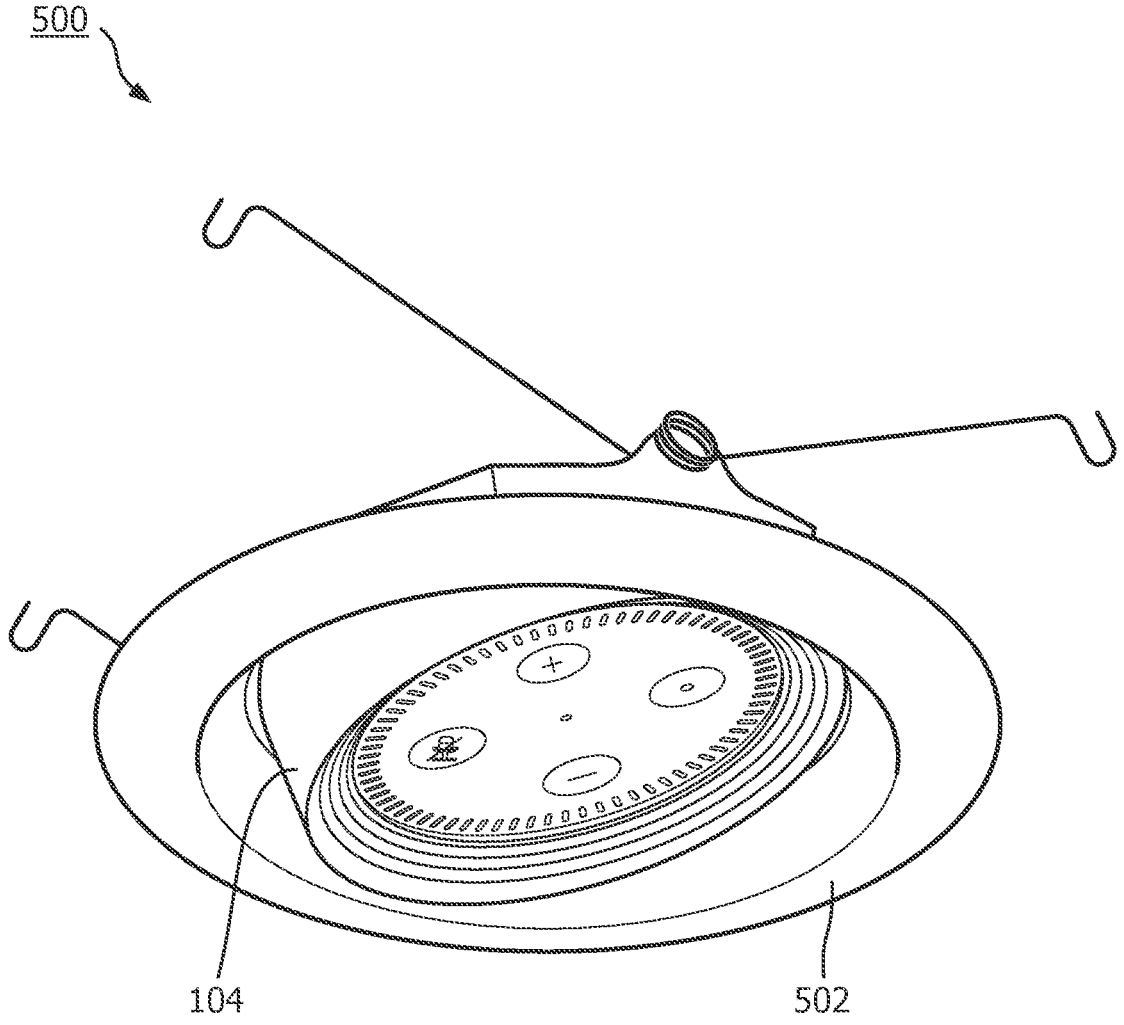
FIG. 6 illustrates a voice-enabled device assembly of FIG. 5 in a tilted position according to an example embodiment.

FIG. 5 illustrates an exploded view of the voice-enabled device assembly 500 according to another example embodiment. FIG. 6 illustrates the voice-enabled device assembly 500 of FIG. 5 in a tilted position according to an example embodiment. For example, the voice-enabled device assembly 500 may be used in the voice-enabled device fixture of FIG. 1 in place of the voice-enabled device assembly 102. Referring to FIGS. 1-5, in some example embodiments, the voice-enabled device assembly 500 includes the voice-enabled device 104 and the brackets 202, 204. The voice-enabled device assembly 500 may also include a trim 502, a spin ring 504, and a tilt ring 506. The trim 502 may include an outer flange 508 and an inner flange 510, and the spin ring 504 may be positioned on the inner flange 510 such that the spin ring 504 can rotate horizontally while in contact with the inner flange 510. The outer flange may be at least partially positioned below the ceiling 110.

In contrast to the voice-enabled device assembly 500, the brackets 202, 204 are attached to the spin ring 504 and the tilt ring 506, where the voice-enabled device 104 is positioned on a flange 520 of the tilt ring 506. To illustrate, fasteners, such as the fastener 212, 312, may be used to attach the brackets 202, 204 to the spin ring 504 and the tilt ring 506 through respective holes 210, 310 in the brackets 202, 204, respective holes 514, 516 in the spin ring 504, and holes including a hole 518 in the tilt ring 506.

In some example embodiments, the tilt ring 506 may be tilted relative to the spin ring 504. The brackets 202, 204 may retain the voice-enabled device 104 in place in the same manner as described above with respect to FIGS. 1-4. Because the voice-enabled device 104 may be positioned on the flange 520 of the tilt ring 520, the voice-enabled device 520 may be tilted along with the tilt ring 506 and with respect to the spin ring 504. Because the spin ring 504 is not tilted relative to the trim 502, the voice-enabled device 104 can be tilted along with the tilt ring 506 and relative to the trim 502, for example, as shown in FIG. 6. In general, a mounting assembly for the voice-enabled device 104 may include the components of the voice-enabled device assembly 500 without the voice-enabled device 104.

Figure 7:
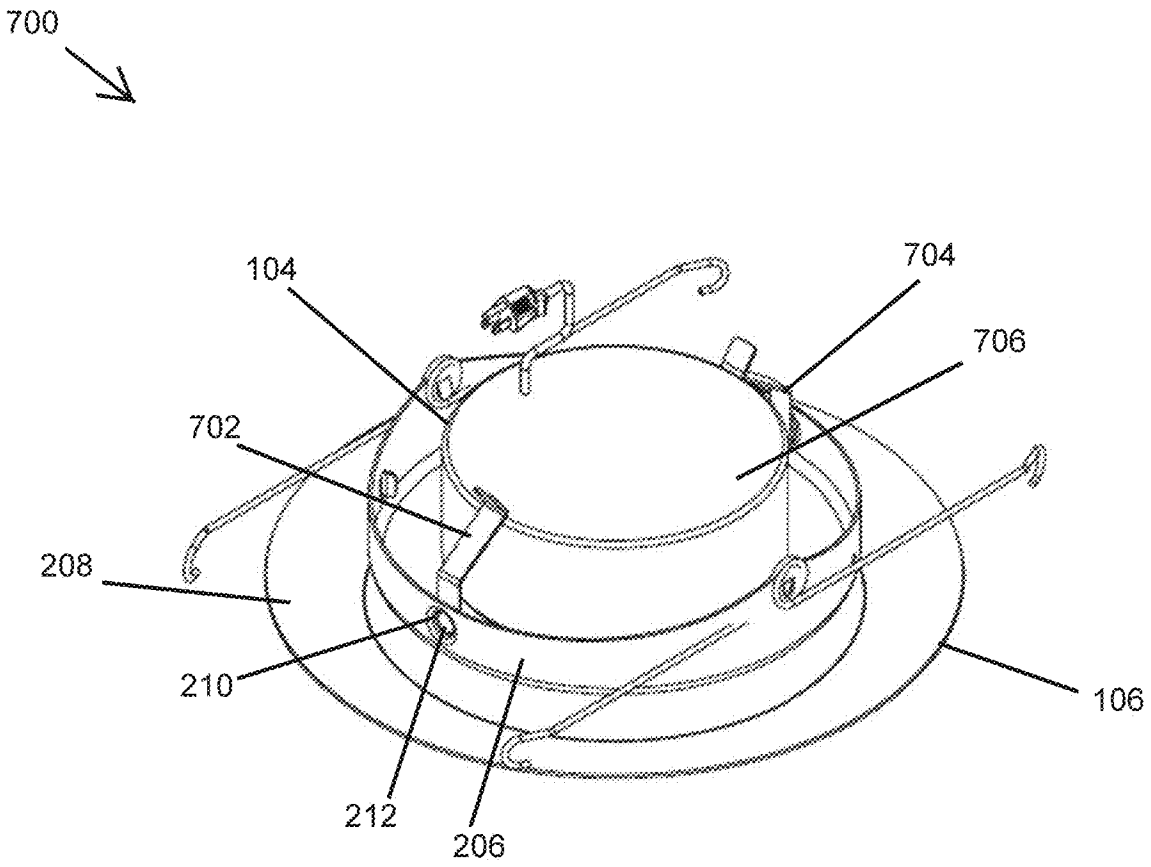
FIG. 7 illustrates a voice-enabled device assembly according to another example embodiment.
Figure 8:
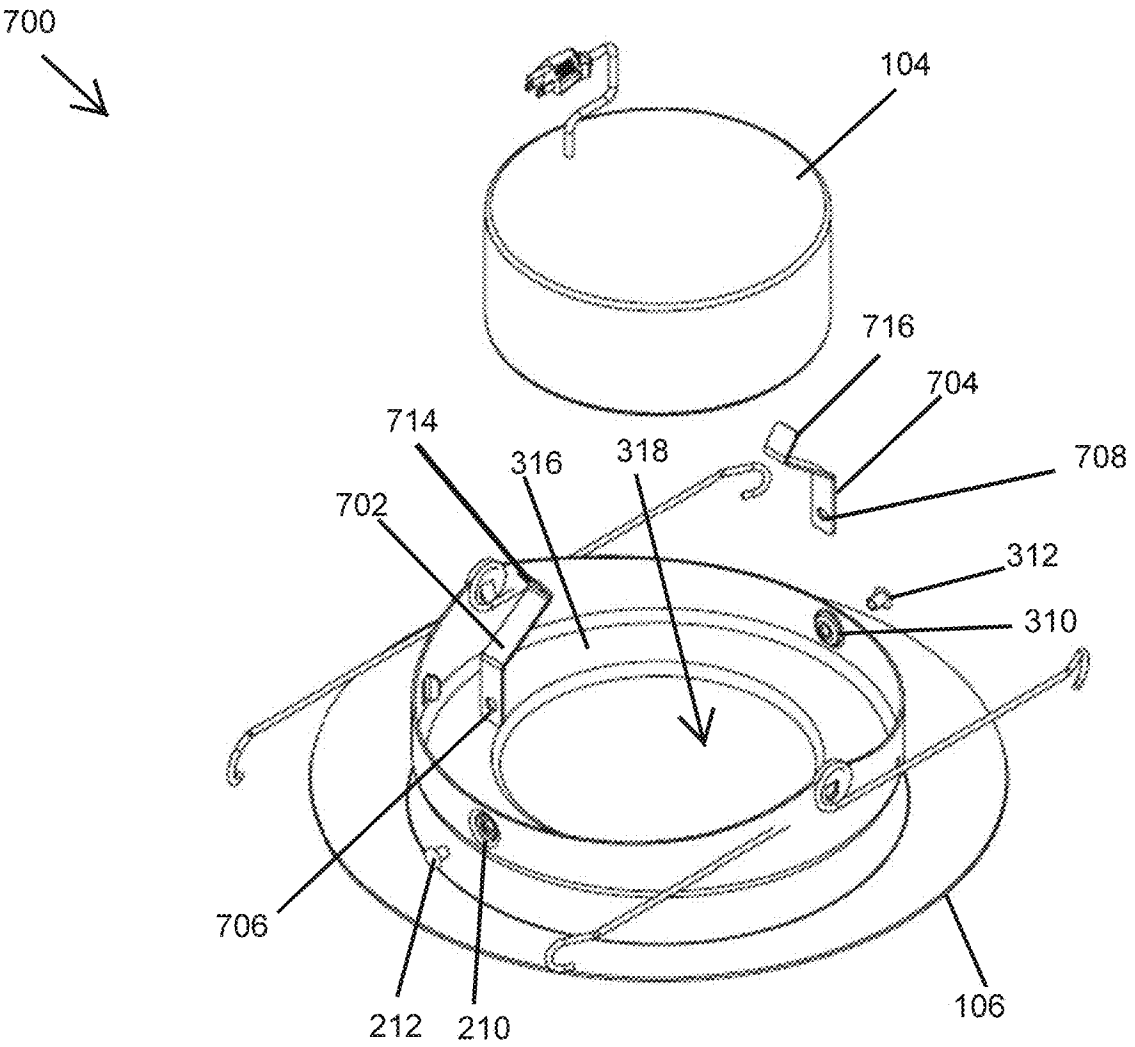
FIG. 8 illustrates an exploded view of the voice-enabled device assembly of FIG. 7 according to another example embodiment.

FIG. 7 illustrates a voice-enabled device assembly 700 according to another example embodiment, and FIG. 8 illustrates an exploded view of the voice-enabled device assembly 700 of FIG. 7 according to another example embodiment. In some example embodiments, the voice-enabled device assembly 700 may be used in the voice-enabled device fixture 100 of FIG. 1 in place of the voice-enabled device assembly 102. Referring to FIGS. 1-8, the voice-enabled device assembly 700 is similar to the voice-enabled device assembly 102, where the voice-enabled device assembly 700 includes spring clips 702, 704 as retaining structures instead of the brackets 202, 204 to hold the voice-enabled device in place.

In some example embodiments, the spring clips 702, 704 may be attached to the trim 106 by fasteners 212, 312 in a similar manner as described with respect to the brackets 202, 204. To illustrate, the spring clip 702 may include a hole 706, and the fastener 212 may extend through the hole 210 in the trim 106 and the hole 706 to securely attach the spring clip 702 to the trim 106. The spring clip 704 may include a hole 708, and the fastener 312 may extend through the hole 310 in the trim 106 and the hole 708 to securely attach the spring clip 704 to the trim 106. The spring clips 702, 704 may be attached to the trim 106 across from each other.

In some example embodiments, the spring clips 702, 704 may be elastic, where the spring clips 702, 704 exert a counteracting force when pushed or stretched outwardly, for example, to place the voice-enabled device 104 under the top sections of the spring clips 702, 704. For example, the spring clips 702, 704 may be made from a metal (e.g., aluminum) or another material using methods such as cutting, bending, etc. The spring clips 702, 704 may apply a downward force on a top surface 706 of the voice-enabled device 104 to retain the voice-enabled device on the inner flange 316 of the trim 106.

In some example embodiments, the spring clips 702, 704 may each include a respective tab portion 714, 716 that may be pushed out (e.g., using fingers or a tool) to stretch out the spring clips 702, 704 to place the voice-enabled device 104 between the spring clips 702, 704 and to remove the voice-enabled device 104 from between the spring clips 702, 704. In some alternative embodiments, the voice-enabled device assembly 700 may include more than two spring clips to retain the voice-enabled device in place on the trim 106 without departing from the scope of this disclosure. In general, a mounting assembly for the voice-enabled device 104 may include the components of the voice-enabled device assembly 700 without the voice-enabled device 104.

Figure 9:
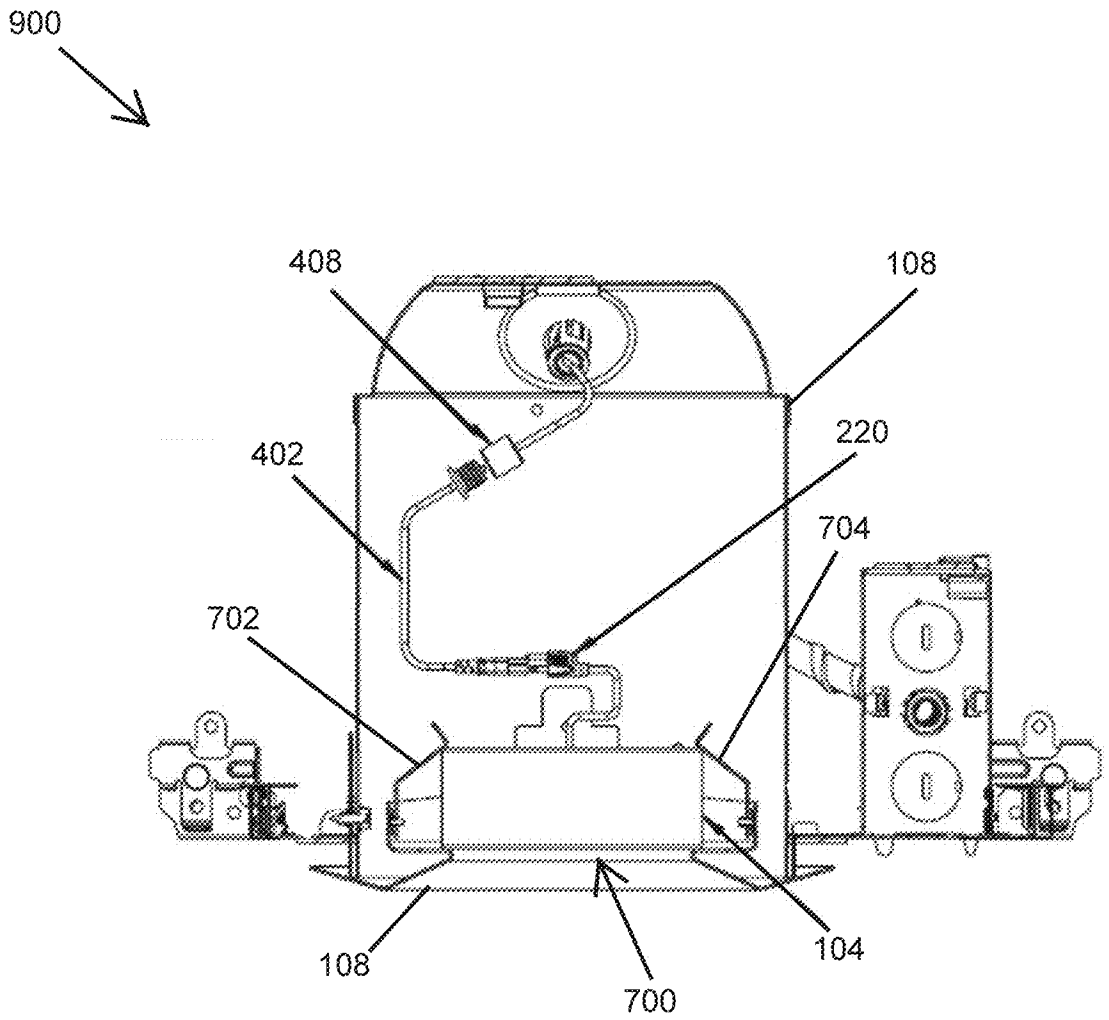
FIG. 9 illustrates a side view of the voice-enabled device fixture according to another example embodiment.

FIG. 9 illustrates a side view of a voice-enabled device fixture 900 according to another example embodiment. Referring to FIGS. 1-9, the voice-enabled device fixture 900 may include the voice-enabled device assembly 700, where the voice-enabled device 104 is at least partially inside the cavity of the housing 108. In general, the voice-enabled device fixture 900 may correspond to the voice-enabled device fixture 100, where the voice-enabled device assembly 102 is replaced by the voice-enabled device assembly 700.

Figure 10:
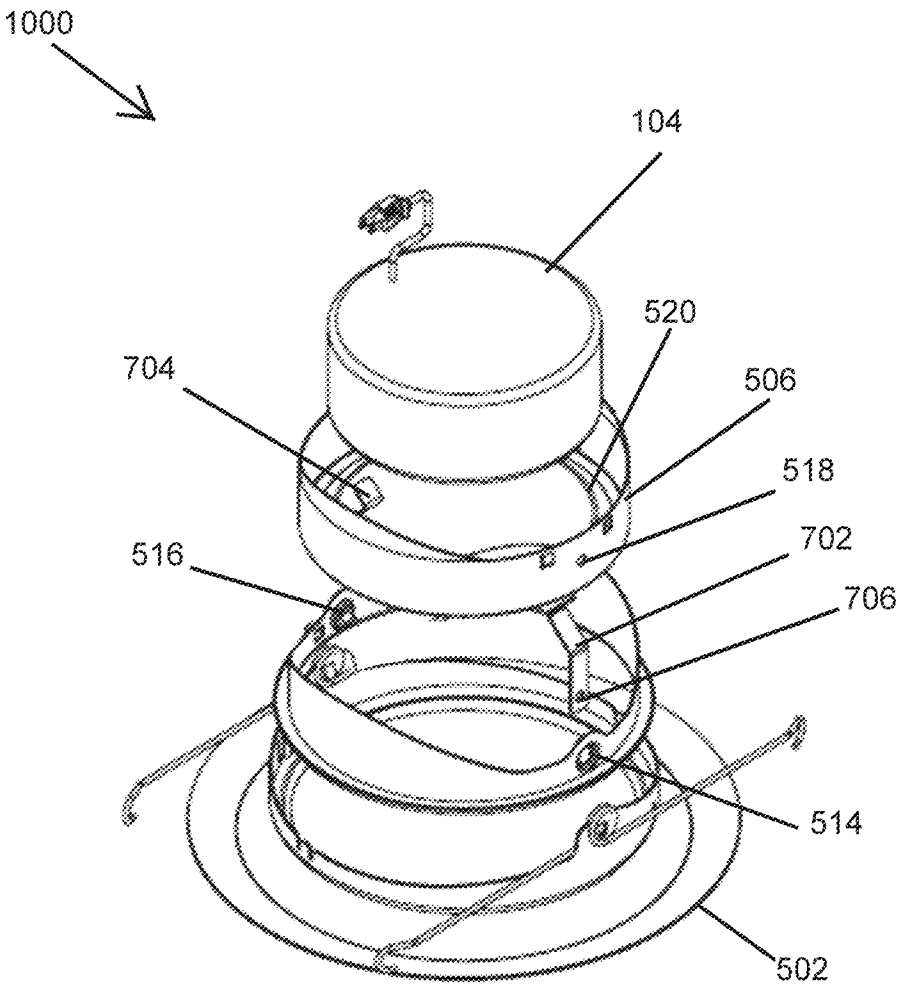
FIG. 10 illustrates an exploded view of a voice-enabled device assembly for use in the voice-enabled device fixture of FIGS. 1 and 9 according to another example embodiment.

FIG. 10 illustrates an exploded view of a voice-enabled device assembly 1000 for use in the voice-enabled device fixtures 100, 900 of FIGS. 1 and 9 according to an example embodiment. For example, the voice-enabled device assembly 1000 may be used in the voice-enabled device fixture 100 of FIG. 1 in place of the voice-enabled device assembly 102. The voice-enabled device assembly 1000 may also be used in the voice-enabled device fixture 900 of FIG. 9 in place of the voice-enabled device assembly 700.

Referring to FIGS. 1-10, in some example embodiments, the voice-enabled device assembly 1000 includes the voice-enabled device 104 and the spring clips 702, 704. The voice-enabled device assembly 1000 may also include the trim 502, the spin ring 504, and the tilt ring 506 shown in FIG. 5. In contrast to the voice-enabled device assembly 700, the voice-enabled device assembly 1000 includes the spring clips 702, 704 that are attached to the spin ring 504 and the tilt ring 506, and the voice-enabled device 104 may be positioned on the flange 520 of the tilt ring 506.

In some example embodiments, fasteners, such as the fastener 212, 312, may be used to attach the spring clips 702, 704 to the spin ring 504 and the tilt ring 506 through respective holes 706, 708 in the spring clips 702, 704, respective holes 514, 516 in the spin ring 504, and holes including the hole 518 in the tilt ring 506. The spring clips 702, 704 may hold the voice-enabled device 104 in place on the flange 520 of the tilt ring 506 by applying a downward force on the top surface 706 of the voice-enabled device 104. The voice-enabled device 104 may be tilted relative to the trim 502 in a similar manner as described with respect to FIGS. 5 and 6. In general, a mounting assembly for the voice-enabled device 104 may include the components of the voice-enabled device assembly 1000 without the voice-enabled device 104.

Figure 11:
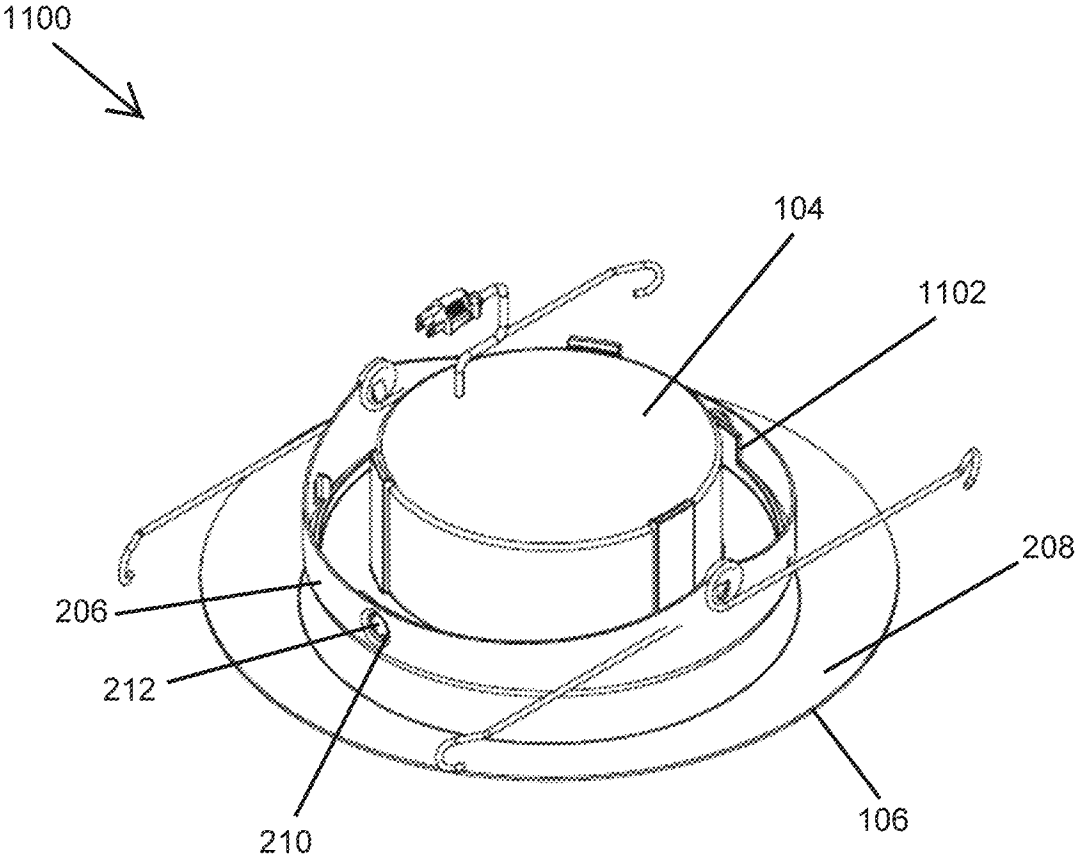
FIG. 11 illustrates a voice-enabled device assembly according to another example embodiment.
Figure 12:
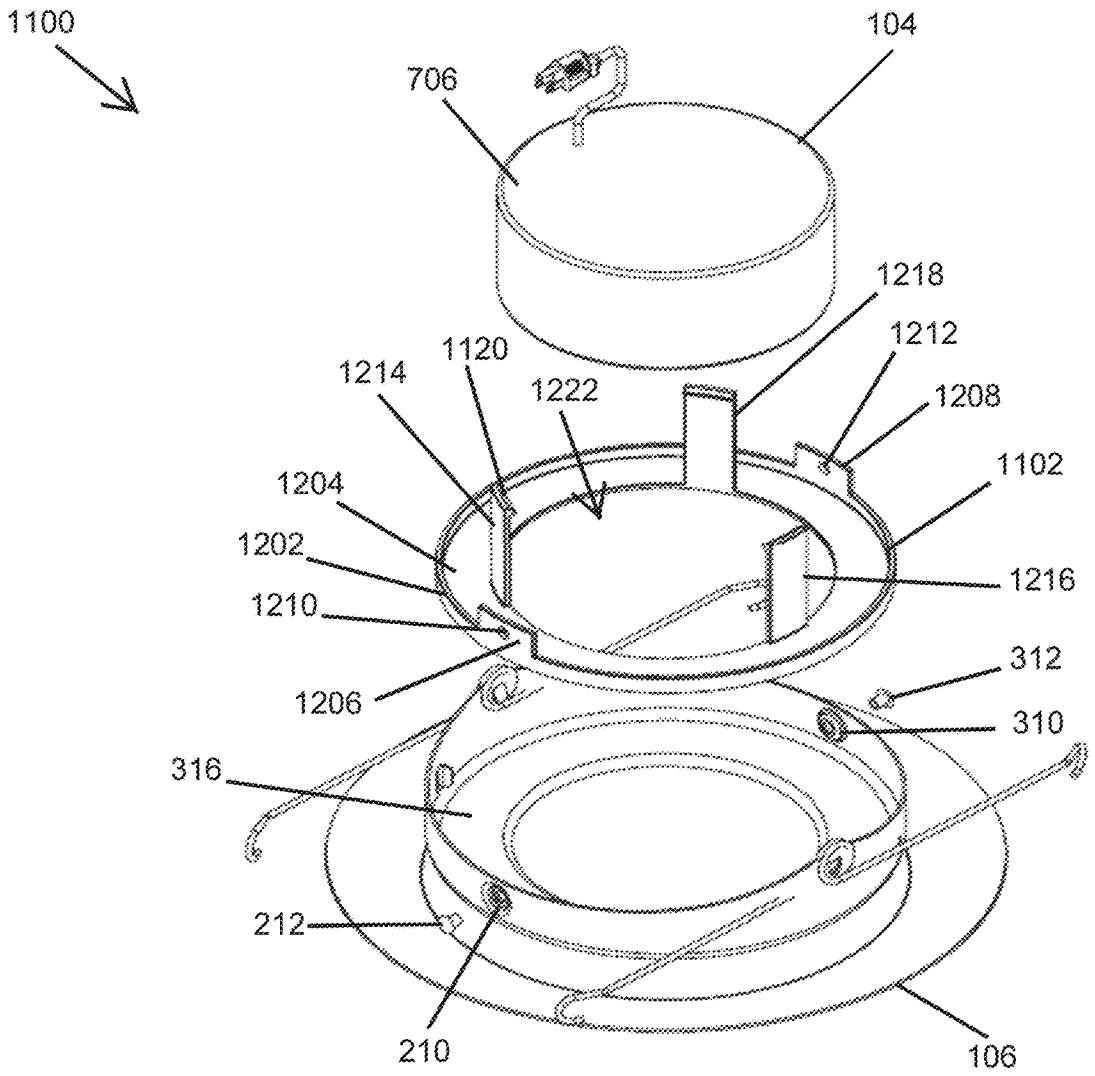
FIG. 12 illustrates an exploded view of the voice-enabled device assembly of FIG. 11 according to another example embodiment.

FIG. 11 illustrates a voice-enabled device assembly 1100 according to another example embodiment, and FIG. 12 illustrates an exploded view of the voice-enabled device assembly 1100 of FIG. 11 according to another example embodiment. In some example embodiments, the voice-enabled device assembly 1100 may be used in the voice-enabled device fixture 100 of FIG. 1 in place of the voice-enabled device assembly 102. Referring to FIGS. 1-12, in some example embodiments, the voice-enabled device assembly 1100 includes the trim 106, a voice-enabled device holder 1102, and the voice-enabled device 104. In general, the voice-enabled device assembly 1100 is similar to the voice-enabled device assembly 102, where the voice-enabled device assembly 700 includes the voice-enabled device holder 1102 as a retaining structure instead of the brackets 202, 204 to hold the voice-enabled device 104 in place. For example, the voice-enabled device holder 1102 may be made from plastic or another suitable material using molding, cutting, and/or other methods as can be readily understood by those of ordinary skill in the art with the benefit of this disclosure.

In some example embodiments, the holder 1102 may include a perimeter wall 1202, a base 1204, tabs 1206, 1108, and spring clips 1214, 1216, 1218. The tabs 1206, 1208 may extend up at an outer perimeter of the holder 1102 and may include a respective hole 1210, 1212. For example, the holder 1102 may be attached to the trim 106 using fasteners 212, 312 the extend through respective holes 210, 310 in the trim 106 and the respective holes 1210, 1212 in the respective tabs 1206, 1208.

In some example embodiments, the holder 1102 may be positioned on the inner flange 316 of the trim 106. The voice-enabled device 104 may also be positioned on the inner flange 316 of the trim 106. For example, the voice-enabled device 104 may be positioned on the inner flange 316 through an opening 1222 of the holder 1102, where the base 1204 surrounds the opening 1222. The spring clips 1214-1218 may extend up from the base 1204 of the holder 1102 proximal to the inner perimeter of the holder 1102. The spring clips 1214-1218 may hold the voice-enabled device 104 in place, for example, by fencing in the voice-enabled device 104. The spring clips 1214-1218 may each include a retaining section, such as the retaining section 1220 of the spring clip 1214, that may come in contact with the top surface 706 of the voice-enabled device 104 and prevent the voice-enabled device from dislodging from the spring clips 1214-1218.

In some example embodiments, the spring clips 1214-1218 may be pushed or pulled out to place the voice-enabled device 104 between the spring clips 1214-1218 and to remove the voice-enabled device 104 from between the spring clips 1214-1218.

In some alternative embodiments, the spring clips 1214-1218 may extend up from the base 1204 such that the spring clips 1214-1218 are not at the inner perimeter of the holder 1102. For example, instead of being positioned on the inner flange 316 of the trim 106, the voice-enabled device 104 may be position on the portion of the base 1204 between the spring clips 1214-1218 and the opening 1222. In some alternative embodiments, the holder 1102 may be integrally built with the trim 106 without departing from the scope of this disclosure. In general, a mounting assembly for the voice-enabled device 104 may include the components of the voice-enabled device assembly 1100 without the voice-enabled device 104.

Figure 13:
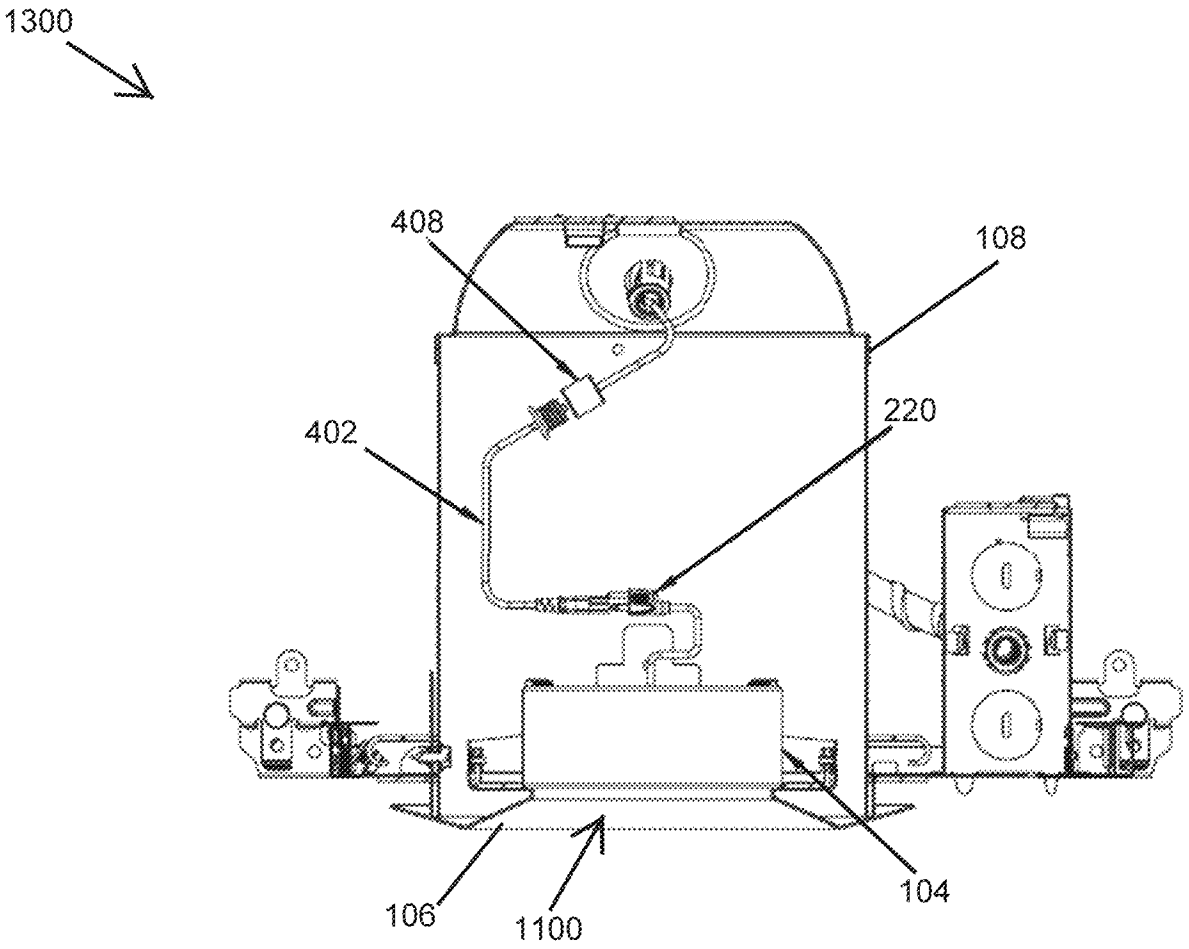
FIG. 13 illustrates a side view of the voice-enabled device fixture according to another example embodiment.

FIG. 13 illustrates a side view of the voice-enabled device fixture 1300 according to another example embodiment. Referring to FIGS. 1-13, the voice-enabled device fixture 1300 may include the voice-enabled device assembly 1100, where the voice-enabled device 104 is at least partially inside the cavity of the housing 108. In general, the voice-enabled device fixture 1300 may correspond to the voice-enabled device fixture 100, where the voice-enabled device assembly 102 is replaced by the voice-enabled device assembly 1100.

Figure 14:
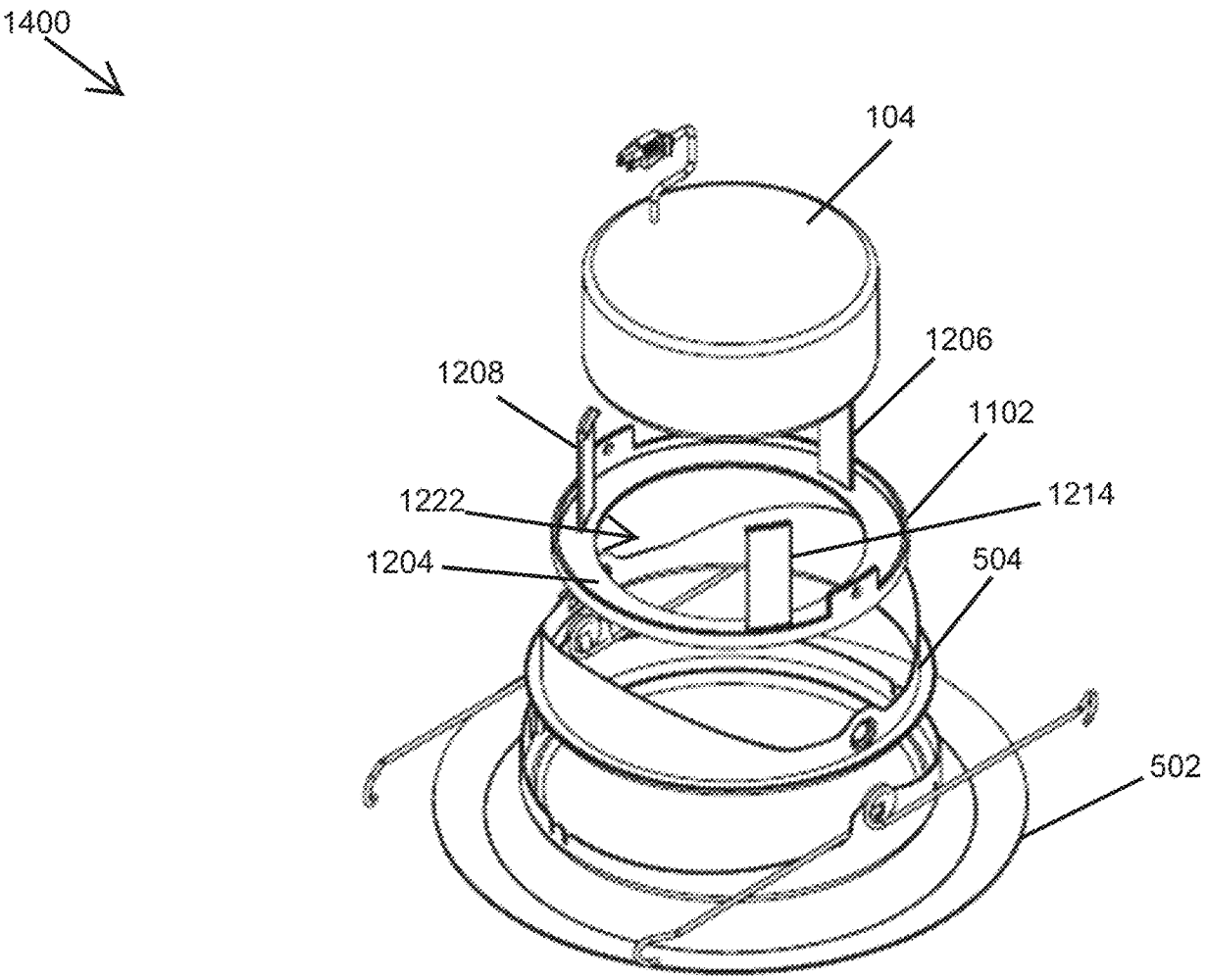
FIG. 14 illustrates an exploded view of a voice-enabled device assembly for use in the voice-enabled device fixture of FIGS. 1 and 13 according to another example embodiment.

FIG. 14 illustrates an exploded view of a voice-enabled device assembly 1400 for use in the voice-enabled device fixture of FIGS. 1 and 13 according to another example embodiment. Referring to FIGS. 1-14, in some example embodiments, the voice-enabled device assembly 1400 may include the trim 502, the spin ring 504, the holder 1102, and the voice-enabled device 104. The holder 1102 may be attached to the spin ring 504 using fasteners (e.g., the fasteners 212, 312) in a similar manner as described with respect to the voice-enabled device assembly 500 and 1000.

In some example embodiments, the spin ring 504 may be positioned on the trim 502, and the voice-enabled device 104 may be positioned on the portion of the base 1204 that is between the spring clips 1214-1218 and the opening 1222. The spring clips 1214-1218 may retain the voice-enabled device 104 in place by exerting downward force as well as by fencing in the voice-enabled device 104. The voice-enabled device 104 may be horizontally rotated along with the spin ring 504 that is positioned on the trim 502. In general, a mounting assembly for the voice-enabled device 104 may include the components of the voice-enabled device assembly 1400 without the voice-enabled device 104.

Although particular embodiments have been described herein in detail, the descriptions are by way of example. The features of the embodiments described herein are representative and, in alternative embodiments, certain features, elements, and/or steps may be added or omitted. Additionally, modifications to aspects of the embodiments described herein may be made by those skilled in the art without departing from the spirit and scope of the following claims, the scope of which are to be accorded the broadest interpretation so as to encompass modifications and equivalent structures.

What is claimed is:

1. A mounting assembly for recessed installation of a voice-enabled device, the mounting assembly comprising:

a trim comprising an outer flange, an inner flange, and a wall section, wherein at least a portion of the outer flange of the trim is designed to be positioned below a ceiling and wherein the inner flange is designed for positioning the voice-enabled device thereon; and retaining structures attached to the wall section, wherein the retaining structures are designed to hold the voice-enabled device on the inner flange.

2. The mounting assembly of claim 1, wherein the retaining structures includes retaining spring brackets that are attached to the trim across from each other.

3. The mounting assembly of claim 1, wherein the retaining structures include spring clips that are attached to the trim across from each other.

4. The mounting assembly of claim 1, wherein the outer flange and the inner flange are separated from one another by the wall section, and the wall section extends toward the ceiling from the outer flange section.

5. The mounting assembly of claim 1, wherein the trim has an opening surrounded by the inner flange, and when the voice-enabled device is held on the inner flange of the trim, the opening is aligned with at least a portion of the voice-enabled device.

6. The mounting assembly of claim 2, wherein each of the retaining spring brackets has a tab with a tab hole therethrough, the wall section has a corresponding wall hole for each tab hole, and a fastener is configured to extend through each pair of tab holes and wall holes.

7. The mounting assembly of claim 2, wherein each of the retaining spring brackets has one or more arms that are configured to be pushed outwardly by the voice-enabled device when the voice-enabled device is positioned between the arms.

8. The mounting assembly of claim 7, wherein the one or more arms are configured to extend around a portion of a wall of the voice-enabled device.

9. A voice-enabled device assembly for recessed installation, the voice-enabled device assembly comprising:

a trim having an inner flange, an outer flange, and a wall section, the outer flange and the inner flange being separated from one another by the wall section;

retaining structures attached to the trim; and a voice-enabled device positioned on the inner flange, wherein the retaining structures hold the voice-enabled device on the inner flange.

10. The voice-enabled device assembly of claim 9, wherein the retaining structures include retaining spring brackets that are attached to the trim across from each other.

11. The voice-enabled device assembly of claim 9, wherein the retaining structures include spring clips that are attached to the trim across from each other.

* * * * *